US009156075B2

(12) United States Patent
Houle et al.

(10) Patent No.: US 9,156,075 B2
(45) Date of Patent: Oct. 13, 2015

(54) LEVER BENDER AND RELATED METHOD OF USE

(71) Applicants: Joseph J. Houle, Westfield, MA (US); Roman Lomeli, Plymouth, MA (US)

(72) Inventors: Joseph J. Houle, Westfield, MA (US); Roman Lomeli, Plymouth, MA (US)

(73) Assignee: IRWIN INDUSTRIAL TOOL COMPANY, Huntersville, NC (US)

( * ) Notice: Subject to any disclaimer, the term of this patent is extended or adjusted under 35 U.S.C. 154(b) by 309 days.

(21) Appl. No.: 13/750,208

(22) Filed: Jan. 25, 2013

(65) Prior Publication Data

US 2014/0208820 A1 Jul. 31, 2014

(51) Int. Cl.
*B21D 9/12* (2006.01)
*B21D 7/06* (2006.01)

(52) U.S. Cl.
CPC . *B21D 9/12* (2013.01); *B21D 7/063* (2013.01)

(58) Field of Classification Search
CPC ..... B21D 9/12; B21D 7/063; B21D 7/02; B21D 7/024; B21D 7/06; B21D 7/066; B21D 9/04; B21D 9/05; B21D 9/07; B21D 9/073; B21D 9/076; B21D 9/08; B21D 9/085
USPC ..... 72/31.04, 31.05, 369, 459, 458, 409.13, 72/409.19, 422, 479, 149, 388; 269/3, 6, 269/95, 261, 268
See application file for complete search history.

(56) References Cited

U.S. PATENT DOCUMENTS

| | | | | |
|---|---|---|---|---|
| 1,899,281 | A | | 2/1933 | Lidseen |
| 3,447,353 | A | | 6/1969 | Noveske |
| 4,379,399 | A | * | 4/1983 | Kowal ..... 72/388 |
| 4,380,922 | A | | 4/1983 | Kowal |
| 4,389,872 | A | | 6/1983 | Kowal |
| 4,403,496 | A | | 9/1983 | Kowal |
| 4,424,699 | A | | 1/1984 | Peppers |
| 4,827,755 | A | | 5/1989 | Strybel |
| 5,390,522 | A | | 2/1995 | Dircks |
| 5,669,258 | A | | 9/1997 | Luebke |
| 5,749,255 | A | | 5/1998 | Arai |
| 5,823,031 | A | | 10/1998 | Campbell et al. |

(Continued)

FOREIGN PATENT DOCUMENTS

| | | |
|---|---|---|
| EP | 1893364 B1 | 8/2010 |
| EP | 1463593 B1 | 12/2011 |

OTHER PUBLICATIONS

Irwin Industrial Tool Company, European Application No. 14000226.2, Extended European Search Report, Jun. 4, 2014.

*Primary Examiner* — A. Dexter Tugbang
*Assistant Examiner* — Joshua D Anderson
(74) *Attorney, Agent, or Firm* — Sutherland Asbill & Brennan LLP

(57) ABSTRACT

A lever bender includes a first handle pivotally attached to a second handle. The first handle includes a forming mandrel around which a pipe is bent and a stop member for receiving and substantially holding the pipe in place prior to bending. The second handle includes a forming head that engages and bends the pipe around the forming mandrel. The stop member includes a pipe-engaging member that receives a pipe and a locking member adjacent to the pipe-engaging member. The locking member includes a retaining member moveable between a projecting position where the retaining member secures the pipe between the pipe-engaging member and the locking member and a retracted position permitting a pipe to either be received within the pipe-engaging member or removed from the pipe-engaging member.

18 Claims, 3 Drawing Sheets

(56) References Cited

U.S. PATENT DOCUMENTS

| | | | | |
|---|---|---|---|---|
| 6,463,780 | B1 * | 10/2002 | Kalanish | 72/388 |
| 6,487,889 | B1 | 12/2002 | Bates et al. | |
| 6,609,405 | B1 | 8/2003 | Bates et al. | |
| 6,883,360 | B2 | 4/2005 | Bates et al. | |
| 7,096,707 | B2 | 8/2006 | Bates et al. | |
| 7,143,629 | B1 | 12/2006 | Chiu | |
| 7,234,338 | B2 | 6/2007 | Mirtz et al. | |
| 8,683,835 | B2 * | 4/2014 | Austaller | 72/31.1 |
| 2006/0277968 | A1 | 12/2006 | Mirtz et al. | |
| 2006/0283230 | A1 | 12/2006 | Bates et al. | |
| 2008/0236240 | A1 | 10/2008 | Bates et al. | |
| 2009/0266137 | A1 | 10/2009 | Andren et al. | |

* cited by examiner

LEVER BENDER AND RELATED METHOD OF USE

FIELD OF THE INVENTION

The present invention relates to pipe benders and more particularly to manual pipe benders.

BACKGROUND OF THE INVENTION

Manual pipe bending is common in the plumbing, piping, heating, ventilation, air conditioning and refrigeration ("HVACR") fields. For example, soft/annealed copper tubing is commonly used in fluid systems (liquid and gaseous), and must be bent on site into the necessary configuration. An HVACR technician, for example, will often use a manual pipe bender, e.g., a lever bender, to bend a piece of tubing rather than solder or braze a curved fitting onto the tubing. Manual tube/pipe bending allows a technician to bend the tubing to desired angles that may not be available with available fittings and is often also more time efficient and less costly.

A typical lever bender has two handles that are pivotable with respect to one another to bend a pipe placed into the bender. Two hands are needed to operate the two handles, in order to pivot them with respect to one another and bend the mounted pipe. The pipe is preferably held in place within the bender while bending, in order achieve a smooth and accurate bend at the desired location along the pipe. Accordingly, the user must stabilize the pipe in place within the bender, and also engage and operate the handles. This can be a cumbersome task. Thus, one drawback of currently available lever benders is the difficultly for a user to maintain a pipe in place in the bender prior to initiating the bending, and then bend the pipe.

Previous attempts to solve this problem include lever benders having different types of stop members for stabilizing the pipe during setup and/or while bending the pipe. However, none of the known stop members adequately maintain the pipe position in all directions during setup and while bending. Therefore, additional stabilization, e.g., by the user, is still required, or there is a risk of movement and/or inaccuracy in the resulting bend.

SUMMARY OF THE INVENTION

It is an object of the present invention to overcome one or more of the above-described drawbacks and/or disadvantages of the prior art.

In one aspect, a device for bending a pipe comprises a first handle including a forming mandrel having an outer edge around which a pipe is bendable and a stop member for receiving and substantially preventing movement of said pipe relative thereto when engaged therewith, and a second handle pivotable relative to the first handle and including a forming head adapted to engage and bend a pipe around the forming mandrel when the second handle is pivoted toward the first handle. The stop member includes a pipe-engaging member adapted to fittingly receive a pipe therein and a locking member adjacent to said pipe-engaging member, said locking member including a retaining member moveable between (I) a normally projecting position wherein said retaining member secures said pipe between the locking member and the pipe-engaging member and, and in turn, substantially preventing movement of said pipe, and (II) a retracted position wherein a pipe is one of (i) movable past the retaining member and into engagement with the pipe-engaging member and (ii) movable from engagement with the pipe-engaging member, past the retaining member, and out of engagement with the pipe-engaging member, a biasing member configured to exert a biasing force on the retaining member and bias the retaining member toward the normally projecting position.

In some embodiments, the locking member further includes a bias adjusting member configured to adjust the biasing force the biasing member exerts on the retaining member.

In some embodiments, the biasing member engages the retaining member in compression to exert said biasing force thereon, and the bias adjusting member comprises a screw threadingly engaged with the locking member and rotatable relative thereto to adjust said compression of the biasing member, and in turn, said biasing force.

In some embodiments, the pipe-engaging member comprises a hook-shaped member configured to engage at least a portion of a circumference of a pipe when engaged with the pipe-engaging member.

In some embodiments, the outer edge of the forming mandrel defines a shape or radius of curvature adapted to substantially provide a pipe with said shape or curvature when bent around the outer edge.

In some embodiments, the outer edge of the forming mandrel defines a pipe channel configured to receive successive portions of a pipe as it is bent around said outer edge.

In some embodiments, the forming head includes at least one channel configured to engage a pipe and press said pipe to and around the outer edge of the forming mandrel when the second handle is pivoted toward the first handle.

In some embodiments, the biasing member comprises a spring.

In accordance with another aspect, a device for bending a pipe comprises a first handle including first means around which a pipe is bendable and second means for receiving and substantially preventing movement of said pipe relative thereto when engaged therewith, and a second handle pivotable relative to the first handle and including third means for engaging and bending a pipe around said first means when the second handle is pivoted toward the first handle. The second means includes fourth means for fittingly receiving a pipe therein and fifth means for securing the pipe therebetween and for substantially preventing movement thereof adjacent to said fourth means, said fifth means including sixth means for retaining the pipe within the fourth means and for moving between (I) a normally projecting position wherein said sixth means secures said pipe between the fifth means and the fourth means, and (II) a retracted position wherein a pipe is one of (i) movable past the sixth means and into engagement with the fourth means and (ii) movable from engagement with the fourth means, past the sixth means, and out of engagement with the fourth means; and seventh means for exerting a biasing force on the sixth means and for biasing the sixth means toward the normally projecting position.

In some embodiments, the fifth means further comprises eighth means for adjusting said biasing force exerted by the seventh means on the sixth means.

In some embodiments, the first means is a forming mandrel, the second means is a stop member, the third means is a forming head, the fourth means is a pipe-engaging member, the fifth means is a locking member, the sixth means is a retaining member, the seventh means is a biasing member, and the eighth means is a bias adjusting member.

In accordance with another aspect, a method of bending a pipe comprises mounting a pipe within a pipe bending device comprising a first handle including a forming mandrel having an outer edge around which a pipe is bendable and a stop member for receiving and substantially preventing movement of said pipe relative thereto when engaged therewith, and a second handle pivotable relative to the first handle and including a forming head adapted to engage and bend a pipe around the forming mandrel when the second handle is pivoted toward the first handle. The stop member includes a pipe-engaging member adapted to fittingly receive a pipe therein and a locking member adjacent to said pipe-engaging member, said locking member including a retaining member moveable between (I) a normally projecting position wherein said retaining member secures said pipe between the locking member and the pipe-engaging member and, and in turn, substantially preventing movement of said pipe, and (II) a retracted position wherein a pipe is one of (i) movable past the retaining member and into engagement with the pipe-engaging member and (ii) movable from engagement with the pipe-engaging member, past the retaining member, and out of engagement with the pipe-engaging member, and a biasing member configured to exert a biasing force on the retaining member and bias the retaining member toward the normally projecting position. The mounting step comprises inserting the pipe between the forming mandrel and the forming head at a first portion of the pipe to be bent; moving a second portion of the pipe into engagement with the stop member by moving the second portion in between the locking member and the pipe-engaging member to secure the pipe therebetween, thereby substantially preventing movement of the pipe; and pivoting the second handle toward the first handle to a desired bending angle, thereby bending the pipe around the forming mandrel to said bending angle.

In some embodiments, the outer edge of the forming mandrel defines a pipe channel, and the inserting step comprises placing the first portion of the pipe within the pipe channel.

In some embodiments the moving step further comprises applying a force greater than the biasing force exerted by the biasing member onto the retaining member and thereby moving the retaining member from the projecting position to the retracted position, and, in turn, sliding the second portion of the pipe past the retaining member toward the pipe-engaging member thereby allowing the retaining member to return to the projecting position and secure the pipe therebetween.

In some embodiments, the locking member further includes a bias adjusting member configured to adjust the biasing force the biasing members exerts on the retaining member, and further comprising the step of adjusting the bias adjusting member to thereby adjust the biasing force. In some such embodiments, the bias adjusting member comprises a screw threadingly engaging the locking member, and the adjusting step comprises rotating the screw relative to the locking member, thereby adjusting compression of the biasing member, and, in turn adjusting the biasing force.

In some embodiments, the pivoting step further comprises holding solely the first handle with one hand, and holding solely the second handle with another hand, and pivoting the second handle toward the first handle.

In some embodiments, method further comprises pivoting the second handle away from the first handle, moving the pipe out of engagement with the stop member by moving the pipe from between the locking member and the pipe-engaging member by applying a force greater than the biasing force exerted by the biasing member onto the retaining member and thereby moving the retaining member from the projected position to the retracted position and, in turn, removing the pipe from the pipe-engaging member, and removing the pipe from between the forming mandrel and the forming head.

Further objects and advantages of the present invention, and/or of the currently preferred embodiments thereof, will become more readily apparent in view of the following detailed description of the currently preferred embodiments and accompanying drawings.

DETAILED DESCRIPTION OF EMBODIMENTS OF THE INVENTION

Figure 1:
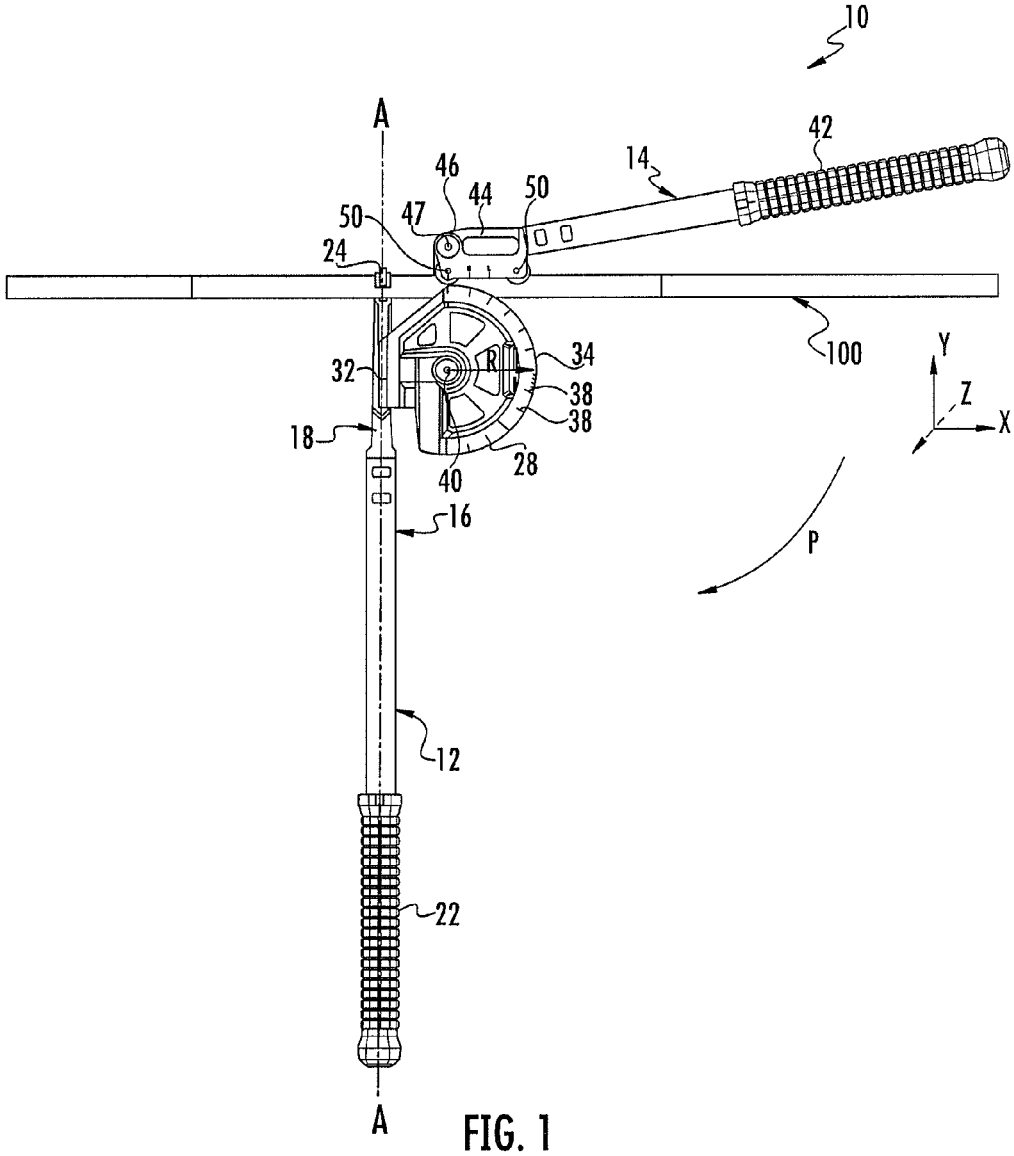
FIG. 1 is a side view of a lever bender in a first position, having a pipe mounted therein.

In FIG. 1, a lever bender is indicated generally by the reference numeral 10. The lever bender includes elongated first and second handles 12, 14 and a forming mandrel 28. The handles 12, 14 are pivotally movable with respect to one another, as described further below, in order to bend a pipe mounted in the forming mandrel 28. The term "pipe" is used herein to mean, without limitation, any of various bendable tubing and piping or other materials, whether hollow or solid, and having any shape.

As is known, the bending force required to bend a pipe with the lever bender 10 depends upon factors such as, for example, the shape, diameter (or dimensions in the plane of bending) and material of the pipe, as well as whether the pipe is hollow or solid, and if hollow, the wall thickness of the pipe. As should be recognized by those of ordinary skill in the pertinent art, the magnitude of the bending force applied to a pipe mounted within the lever bender 10 depends in part upon the length of the first and second handles 12, 14, and the force applied to the handles to move them toward one another. Accordingly, the length of the first and second handles 12, 14 is configured according to the type of pipe intended to be bent by a bender 10, such that a user can bend the pipe, and need not apply an excessive, hazardous, or dangerous amount of force in order to do so.

Figure 3:
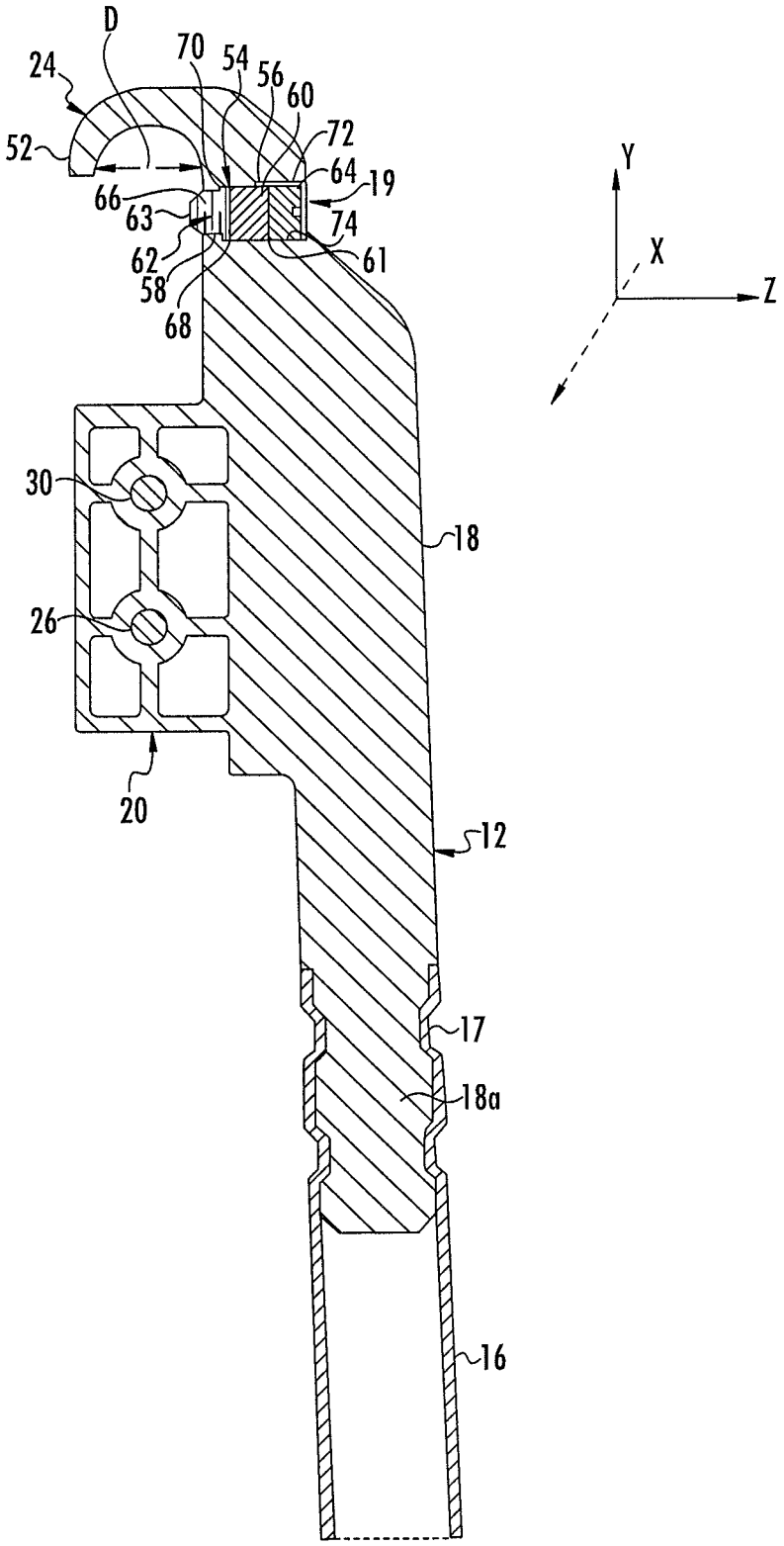
FIG. 3 is an enlarged cross-sectional view of the lever bender of FIG. 1 along the sectional line A-A, having the pipe mounted therein.

The first handle 12 includes proximal portion 16 and distal portion 18. The proximal portion 16 of the first handle 12 is attached to the distal portion 18 of the first handle 12. The distal portion 18 has a projection 18*a* extending from a lateral side of the distal portion 18 to which the proximal portion 16 is attached. This helps locate the proximal portion 16 laterally offset with respect to the plane of bending and the second handle 14. Such offset allows for a greater angular range of motion of the handles 12, 14 with respect to one another. In the illustrated embodiment, the offset between the handles 12, 14 allows them to overlap one another, i.e., pass over one another, when pivoted toward one another, rather than interfere with one another or the bent pipe, thereby providing a greater degree of pipe bending capability. As seen in FIG. 3, the proximal portion 16 is attached to the projection 18*a* by crimping the distal end of the proximal portion 16 into grooves 17 in the projection 18*a*. It should be recognized though, that the proximal portion 16 and distal portion 18 may be attached to each other by any suitable means, such as, but not limited to, welding, brazing, riveting, bolting, screwing, pinning, friction or interference fit, etc. Alternatively, the proximal and distal portions 16, 18 may be integrally formed of one piece. The distal portion 18 is configured so that the proximal portion 16 is oriented at an angle, i.e., not parallel to, the plane of bending and the second handle 14. The angle contributes to the offset of the handles 12, 14. The angle of the first handle 12 relative to the second handle 14 also can further enhance the stability of the bender during operation. In other embodiments, the distal portion 18 can be configured so that the proximal portion 16 is oriented parallel to the plane of bending and the second handle 14. As should be recognized by those of ordinary skill in the pertinent art however, other configurations of the first and second handles 12, 14 may be utilized to obtain substantially the same functionality.

In the illustrated embodiment, the proximal portion 16 is substantially cylindrical and defines a greater axial extent than the distal portion 18, as shown in FIG. 1. The distal portion 18 is substantially plate-like, i.e., defines a flat surface. However, it should be understood that these configurations of the proximal and distal portions are exemplary and can have any suitable configuration. The proximal portion 16 includes a first hand-grip 22 at a proximal end thereof. The distal end of the distal portion 18 tapers into a neck region 19 that includes a stop member 24, whose functioning is discussed below. The forming mandrel 28 is located on the distal portion 18 of the first handle 12. In the illustrated embodiment, the distal portion 18 includes a projection 20 located between the neck portion 19 and the interface between the proximal and distal portions 16, 18. The projection 20 defines mounting holes or slots 26 by which the forming mandrel 28 is attached thereto via screws or pins 30. The projection 20 also helps locate the proximal portion 16 offset from the bending plane and handle 14. In some embodiments the screw or pins 30 are removable to allow replacement of the forming mandrel 28. As may be recognized by those of ordinary skill in the pertinent art, the forming mandrel 28 may be attached or fixed to the distal portion 18, and thus to the first handle 12, via any suitable means, currently known or that later become known, such as, without limitation, riveting, welding, clamping, etc. In yet other embodiments, the forming mandrel 28 is integrally formed with the distal portion 18.

As shown in FIG. 1, the forming mandrel 28 is attached to the distal portion 18 of the first handle 12 at a flat, inner edge 32 thereof, and defines a substantially semi-circular opposing outer edge 34 around which a pipe 100 is bendable. The semi-circular outer edge 34 defines a pipe channel 36 therein, configured to receive further portions of a pipe 100 as it is progressively bent. The pipe channel 36 is sized and shaped to fittingly receive a bottom side of a pipe 100 of a diameter or other shape that the lever bender 10 is configured to bend. The pipe channel 36 defines a radius of curvature R or other bend shape into which the pipe is bent when the bender is operated. As should be understood by those of ordinary skill in the art, the radius of curvature or bend shape is provided so as to supply the pipe with a desired curvature or shape, e.g., without crimping, flattening, distorting, or thinning the pipe, or otherwise affecting the structural integrity of the pipe or flow through the pipe (if hollow) to a degree that would overly degrade the performance or make it unsafe or unsuitable for its intended use. In the illustrated embodiment, the forming mandrel 28 also includes angle degree markings 38 on either side thereof to inform the user of the bending angle, i.e., how many degrees a pipe 100 has been bent. The forming mandrel 28 further includes a substantially central hole or slot 40 (shown best in FIG. 1), for pivotally attaching the second handle 14 thereto, as described below.

The second handle 14 includes a second hand-grip 42 at a proximal end thereof. As should also be recognized by those of ordinary skill in the pertinent art, the first and second hand-grips 22, 42 can be configured to mitigate slippage between a user's hands (not shown) and the bender 10, during use, and to aid in pivoting of the handles 12, 14. For example, the gripping surfaces of first and second hand-grips 22, 42 may include a substantially anti-slip or non-slip material, to mitigate slippage between a user's hands and the bender 10. In addition, in the illustrated embodiment, the first and second hand-grips 22, 42 are substantially straight. However, as should be understood by those of ordinary skill in the pertinent art, the first and second hand-grips 22, 42, may also be bent or curved, to provide ergonomic grips for a user and to provide a more mechanically advantageous configuration, which assist the user in moving the handles 12, 14 toward one another during bending. For example, the hand-grips 22, 42 may be bent up to approximately 20° inwardly from the elongated axis of the respective handles 12, 14, i.e., bent toward the forming mandrel 28.

Figure 2:
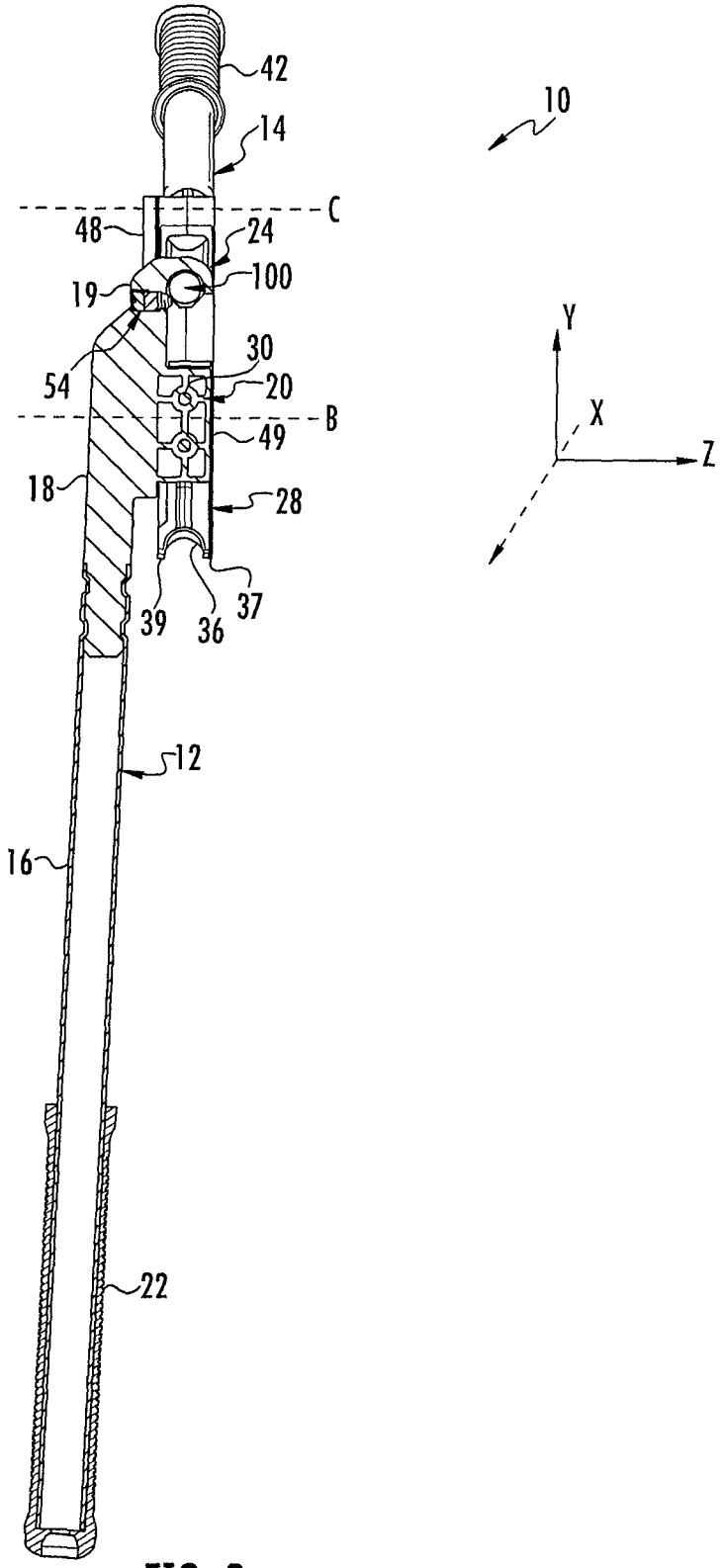
FIG. 2 is a cross-sectional view of the lever bender of FIG. 1 along the sectional line A-A, having the pipe mounted therein.

The second handle 14 also includes a forming head 44 at a distal end thereof. The forming head 44 includes a distal hole or slot 46, for pivotally attaching the second handle 14 to a corresponding hole or slot (not shown) in one end of a plate 48 (shown best in FIG. 2), via an attaching member 47, such as, for example, a pin or bearing. The opposing end of the plate 48 is pivotally attached, via another attaching member 49, such as, for example, a pin, or bearing, to the central slot 40 of the forming mandrel 28. The slots 40 and 46 define pivoting axes B, C, respectively, extending therethrough, about which the plate 48 and second handle 14 can rotate, respectively. The pivotal attachment of the plate 48 to the central slot 40 of the forming mandrel 28 allows the second handle 14 to pivot with respect to the first handle 12 about the central slot axis B, in order to bend a pipe 100 mounted in the bender 10. The pivotal attachment of the forming head 44 (and consequently the second handle 14 to which it is attached) to the plate 48 allows the forming head 44 to be pivoted, and thus spaced away from the forming mandrel 28, about the slot axis C, in order to place a pipe 100 into the pipe channel 36 between the forming head 44 and the forming mandrel 28, as described further below. As should be understood by those of ordinary skill in the pertinent art, in some embodiments the attaching members 47 and 49 are removable to allow replacement of the plate 48 and/or the second handle 14.

As shown in FIG. 1, the forming head 44 at the distal end of the second handle 14 includes rollers 50 that each define a roller channel (not shown). The rollers 50 are rotationally attached to the forming head 44, such as for example, by pins or bearings, to permit rotation thereof about an axis extending therethrough (and parallel to the axis B). The outer edges of the rollers are configured to engage the outer edges 37, 39 of the pipe channel 36 when the second handle 14 is pivoted about the axis C toward the forming mandrel 28. Similarly to the pipe channel 36, the roller channels are sized and shaped to substantially fittingly receive a top side of a pipe 100 of a diameter or other shape that the lever bender 10 is configured to bend. The only portion of the forming head 44 that contacts the pipe 100 is the rollers 50. When a pipe 100 is placed within the pipe channel 36 and the second handle 14 is pivoted toward the forming mandrel 28 so that the outer edges of the rollers 50 engage the outer edges 37, 39 of the pipe channel 36, the rollers channels substantially fittingly engage the top side of the pipe 100. In turn, the pipe channel 36 and roller channel of the roller 50 toward the distal end of the forming head 44 together substantially surround and engage the circumference or perimeter of the pipe 100. In operation, when the second handle 14 is pressed toward the first handle 12, the second handle 14, including the forming head 44, pivots about the central slot axis B and deformingly presses the pipe toward and into the pipe channel 36 to bend the pipe into the radius or shape defined by the pipe channel 36. The continued movement of the second handle 14 toward the first handle 12 causes further pivoting of the second handle 14, which causes the forming head 44 to move relative to and along the pipe 100 and the forming mandrel 28 so as to press, deform and bend a subsequent portion of the pipe 100 into the pipe channel 36. This relative movement of the forming head 44 and the pipe 100 and forming mandrel 28 results in friction between the contacting surfaces of the parts and causes the rollers 50 rotate about their axes. In effect, the rollers 50 roll along the top of the pipe 100 and the outer edges 37, 39 of the pipe channel 36. Generally, the coefficient of rolling friction is less than the coefficient of sliding friction and thus the rollers reduce the force required to bend the pipe 100 (which force must also overcome frictional forces in addition to the force needed to deform the pipe 100). The rollers also help prevent frictional binding of the forming head 44 and the pipe 100, which can distort or even damage the pipe 100. It should be understood, though, that other embodiments may not have rollers. For example, the forming head 44 itself may define a forming channel, which engages and bends the pipe as it slides along the pipe and forming mandrel.

The stop member 24 at the distal end of the first handle 12 is configured to fittingly receive a portion of the pipe 100, to stabilize the pipe and aid a user in setting up the pipe 100 for bending, and also to substantially prevent the pipe from detrimentally moving in any direction during bending. As shown in FIG. 3, the stop member 24 includes a pipe-engaging member 52 and a locking member 54 proximally adjacent to the pipe-engaging member 52 for retaining and securing the pipe 100 therebetween, thereby substantially preventing free movement thereof. When secured between the locking member 54 and the pipe-engaging member 52, a pipe 100 will be substantially prevented from freely moving in any of the x, y or z directions, as shown in FIG. 1. In one embodiment, as shown in FIG. 3, the pipe-engaging member 52 defines a hook-shaped member formed integrally with the distal portion 18 of the first handle 12. The size or diameter D of the hook-shaped member 52 is configured to fittingly receive pipes of a predetermined size or diameter for which the bender 10 is configured to bend. The hook-shaped member 52 is also configured, e.g., long enough, to engage enough of the perimeter or circumference of the pipe 100 to hold it against the first handle 12. In the illustrated embodiment, for example, the hook-shaped member 52 wraps around approximately half of the circumference of the pipe 100 so as to restrict movement of the pipe in the positive and negative z-direction and also in the positive y-direction. The locking member 54 restricts movement in the negative y-direction. Movement in the x-direction is restricted by frictional force between the pipe 100 and the locking member 54 and pipe-engaging member 52, which in part results from the force the locking member 54 exerts against the pipe 100, as described further below.

However, as should be recognized by those of ordinary skill in the pertinent art, the hook-shaped member 52 may be configured to engage more or less than half of the circumference of the pipe 100, while still holding the pipe 100 against the first handle 12. As also may be recognized by those of ordinary skill in the pertinent art based on the teachings herein however, the pipe-engaging member 52 may take the form of any of numerous different members, currently known or that later become known, capable of fittingly receiving a pipe and performing the functions of the pipe-engaging member as described herein.

The locking member 54 extends transversely through an opening slot 56 through the neck portion 19 of the first handle 12. The slot 56 also defines a lip 58 therein, extending radially inwardly, adjacent the pipe-engaging member 52, thereby defining a portion of the slot 56 that has a smaller slot diameter than the diameter of the remainder of the slot 56.

The locking member 54 includes a retaining member 62 and a biasing member 60 for engaging and biasing the retaining member toward and into engagement with a pipe 100 mounted in the stop member 24 The retaining member 62, configured to slidingly engage with the different diameters of the slot 56, has a narrower portion 66 and a wider portion 68, defining a shoulder 70 therebetween, which engages the lip 58 and limits the forward extent movement (in the direction toward the pipe 100) of the retaining member 62. The retaining member 62 may move in the opposite direction (away from the pipe) against the biasing force of the biasing member 60. In the illustrated embodiment, the portion 66 of the retaining member 62 defines a substantially curved tip 63 to engage the pipe 100 and allow the pipe 100 to pass/slide over it, as will be described further below.

In the illustrated embodiment, the biasing member 60 is a coil spring. However, as should be recognized by those of ordinary skill in the pertinent art based on the teachings herein, the biasing member may take the form of any spring or other biasing member, currently known or that later becomes known, capable of performing the function of the biasing member as described herein. The biasing member 60, located within the slot 56, biases the retaining member 62 into a normally projecting position (as shown in FIG. 3), where at least part of the retaining member 62 protrudes from the distal portion 18 of the first handle 12 toward the hook-shaped member 52.

When an opposing force greater than the force of the biasing member 60 is applied to the retaining member 62, it can be moved toward a retracted position, wherein the retaining member 62 is sufficiently retracted within the first handle 12 to allow the pipe 100 to be moved past the retaining member 62 and mounted into the hook-shaped member 52. This opposing force can be applied to the retaining member 62, for example, by the pipe 100 itself when the user pushes the pipe 100 into the stop member 24 and against the pipe-engaging member 52. In some embodiments, the outer edge of the retaining member 62 is depressed until substantially flush with the surface of the distal portion 18 or the first handle 12, thereby allowing the pipe to be inserted into the stop member 24 against the pipe-engaging member 52. Once the opposing force diminishes or ceases, e.g., the pipe 100 is moved past the retaining member 62, the biasing member 60 naturally biases the retaining member 62 back toward the projecting position.

The biasing member 60 is secured in the slot 56. In the illustrated embodiment, as shown best in FIG. 3, a bias adjusting member 64 is also located within the slot 56 adjacent the biasing member 60. The bias adjusting member 64 abuts the end of the biasing member 60 opposite the end engaging the retaining member 62. In the illustrated embodiment, the bias adjusting member 64 comprises a threaded member, e.g., a set screw, whose external threads 72 engage internal threads 74 of the slot 56. The bias adjusting member 64 is adjustable in an axial direction along the slot 56, e.g., by rotating the screw, to selectively compress or decompress the biasing member 60 against the retaining member 62, thereby adjusting the magnitude of the force exerted by the biasing member 60 on the retaining member 62 in a direction from the retracted position to the projecting position, and therefore also adjusting the magnitude of the opposing force required to move the retaining member 62 from the projecting position to the retracted position. If the screw 64 is rotated to increase the compression of the biasing member 60, for example, the biasing member 60, in turn, exerts a greater biasing force on the retaining member 62 in a direction toward the projecting position.

Accordingly, a greater opposing force will be required to move the retaining member 62 in a direction from the projecting position to the retracted position. Conversely, if the screw 64 is rotated to decompress the biasing member 60, the member 60, in turn, will exert a lesser force on the retaining member 62 in a direction toward the projecting position. Accordingly, a relatively lesser opposing force will be required to move the retaining member 62 in a direction from the projecting position to the retracted position.

The bias adjusting member 64 is located within a portion of the slot 56 defining an increase in diameter, e.g., a step increase, with respect to the remainder of the slot 56 where the biasing member 60 and the retaining member 62 are located. Thus, a lip 61 is defined in the slot 56 at the interface between the different diameter adjacent portions, extending radially inwardly. The lip 61 of the adjusting member projection limits the maximum "forward" movement of the bias adjusting member 64, in a direction toward the biasing member 60, thereby limiting the maximum biasing force exerted onto the retaining member 62. Such limiting of the maximum "forward" movement can help mitigate over compression or damage to the biasing member 60 and/or the retaining member 62. Alternatively the slot 56 may be of uniform diameter and/or not include the lip 61.

In another embodiment (not shown), the neck 19 includes a projection that projects from the opposite side of the neck 19 relative to the slot 56. The projection defines an adjusting member slot therethrough, aligned, and adjoining with the opening slot 56, receiving the bias adjusting member 64 therein. The adjusting member slot can be larger than the slot 56 and/or the adjusting member projection defines a lip, similar to lip 58, therein, adjacent the slot 56, extending radially inwardly, so as to form a stop or limit that defines the limit that the adjusting member 64 can be adjusted in a direction toward the retaining member 62. The bias adjusting member 64 is adjustable along the adjusting member slot, in substantially the same manner as above-described with respect to the illustrated embodiment. As may be recognized by those of ordinary skill in the pertinent art based on the teachings herein, the bias adjusting member 64 may take the form of any adjusting member, currently known or that later becomes known, capable of adjusting the force of the biasing member as described herein.

As also may be recognized by those of ordinary skill in the pertinent art based on the teachings herein, the locking member 54 may take the form of any of numerous different locking members, currently known or that later become known, capable of securing a pipe within the pipe-engaging member and substantially preventing free movement of the pipe in the x, y, or z directions as described herein. In some embodiments, the locking member 54 does not have a biasing member. Rather, the retaining member is held in place and moved between retracted and projecting positions by other means as will be appreciated by those of ordinary skill in the art. In one such embodiment, the retaining member and the adjustment member are formed integral with each other such that the retaining member is held in place by the threaded connection between the adjustment member and the projection and/or the slot. The retaining member is moved between the projecting and retracted positions by adjusting, e.g., rotating, the adjustment member along the slot.

In use, the first and second handles 12 and 14 are moved apart from each other sufficiently, such as shown in FIG. 1, to mount a pipe between forming head 44 and the forming mandrel 28. The handles 12 and 14 need to be opened apart enough so that the rollers 50 are pivoted away from and spaced far enough from the forming mandrel 28 such that a pipe 100 can be inserted therebetween and placed in the pipe channel 36. The pipe 100 is then mounted in the lever bender 10, i.e., placed in the pipe channel 36 between the forming head 44 and the forming mandrel 28 at the portion along the pipe 100 in need of bending. Initially, the pipe 100 is placed in the pipe channel 36 at an angle (not perpendicular to but at an obtuse angle to the first handle 12) so as to clear the pipe-engaging member 52 and subsequently mounted into the pipe-engaging member 52 of the stop member 24 thereafter.

In order to mount the pipe 100 into the pipe-engaging member 52, the pipe 100 is pivoted upward toward the stop member 24 and over the locking member 54 with the necessary force to move the retaining member 62 from the projecting position to the retracted position. The pipe 100 is then moved over and past the curved tip 63 of the retaining member 62, and into engagement with the pipe-engaging member 52. The curved shape of the tip 63 translates at least a portion of the upward (positive y-direction) force on the pipe to a force in the negative z-direction to compress the biasing member 60 and retract the retaining member 62. Alternatively, the tip 63 may have a surface that is at an angle to the direction of movement of the pipe (y-direction) so as to translate the force to retract the retaining member.

Once the pipe 100 passes over the locking member 54 and is fittingly received into the pipe-engaging member 52, the biasing member 60 biases the retaining member 62 toward the normally projecting position, thereby securing the pipe 100 in place, between the pipe-engaging member 52 and the locking member 54. The retaining member 62 is spaced from the pipe-engaging member 52 so that it can return toward the projecting position without there being excessive play (space) between the pipe 100 and the retaining member 62 that allows excessive movement of the pipe 100 in the stop member 24. The retaining member 62 thus both physically blocks the pipe 100 from disengaging the pipe-engaging member 52 (moving in the negative y-direction) and also applies a frictional force onto the pipe 100, substantially keeping it in place between the locking member 54 and the pipe-engaging member 52. When the pipe 100 is in place, it is no longer substantially movable in any direction under normal use unless the user intentionally moves it, such as, for example, by pulling the pipe 100 away from the engaging member 52 and back over the locking member 54 with the necessary force to depress the retaining member 62 from the projecting position to the retracted position.

If a user feels that the magnitude of the force required to move the retaining member 62 from the projecting position to the retracted position, i.e., magnitude of the biasing member force, is too strong, the user may adjust, e.g., rotate, the bias adjusting member 64 accordingly to decrease the biasing member force, as discussed above. Similarly, if a user feels that the magnitude of the biasing member force is too little, thereby not securely holding the pipe 100 between the locking member 54 and the pipe-engaging member 52, the user may adjust, e.g., rotate, the bias adjusting member 64 accordingly to increase the biasing member force to ensure that the pipe 100 is substantially prevented from free movement.

Once the pipe 100 is secured between the pipe-engaging member 52 and the locking member 54, the user need not hold the pipe 100 anymore, and need only hold the first and second handles 12, 14 to bend the pipe. As seen in FIG. 1, when the pipe is secured in the bender 10, it is oriented substantially perpendicular to the first handle 12 and tangentially to the forming mandrel 28 through the pipe channel 36. The pipe 100 is bent using the pipe bender 10 in the generally known manner. The second handle 14 is pressed and pivoted toward the first handle 12 to the desired degree, according to the bend required. When the second handle 14 is pivoted toward the first handle 12, the rollers 50 engage the pipe 100 and press the pipe into the pipe channel 36, thereby bending the pipe 100 about the circumference of the forming mandrel 28. As the user continues to press the second handle 14 toward the first handle 12, the second handle 14 continues to pivot about the central slot 40 of the forming mandrel 28. The rollers 50 move along the pipe to engage subsequent sections of the pipe 100, and depress/bend them into the pipe channel 36 of the forming mandrel 28. The pipe-engaging member 52 and the locking member 54 substantially prevent movement of the pipe 100 throughout the bend, particularly during the initial bending of the pipe when frictional forces between the pipe 100 and forming mandrel 28 are minimal. Further, as the second handle 14 is pivoted down toward the first handle, the forming mandrel 28 acts as a fulcrum. The forming head 44 exerts force on the pipe 100 about this fulcrum, resulting in an additional upward force on the pipe 100 into the pipe-engaging member 52, thereby assisting in keeping the pipe 100 in place. Friction between the pipe 100 and the pipe-engaging member 52 during bending also assist in preventing slide or movement of the pipe.

Once the pipe 100 is bent to the necessary or desired amount, the second handle 14 is pivoted back away from the first handle 12 to disengage the forming head 44 from the pipe, and the reverse steps are applied to the pipe 100 to remove the pipe 100 from the stop member 24 and remove it from the lever bender 10. The bent pipe 100 is pulled downward out of the pipe-engaging member 52 and over the locking member 54 with the necessary force to move the retaining member 62 again from the projecting position to the retracted position, and move the pipe 100 over and past the curved tip 63 of the retaining member 62, and out of engagement with the pipe-engaging member 52. Again, the curved (or alternatively, angled) surface of the tip 63 imparts a compressive force to the biasing member 60 to retract the retaining member 62. The pipe 100 may then be removed from the pipe channel 36 and out of the lever bender 10.

As may be recognized by those of ordinary skill in the pertinent art based on the teachings herein, numerous changes and modifications may be made to the above-described and other embodiments without departing from the scope of the invention as defined in the appended claims. For example, the lever bender, including the first and second handles, may be made of any of numerous different materials, currently known, or that later become known. Such materials should be capable of withstanding the force applied thereto, during bending of a pipe, without bending, breaking, or otherwise deforming. For example, the lever bender may be made, without limitation, of steel, aluminum, composite materials, etc., capable of withstanding the forces applied thereto without deforming, while remaining light enough for substantially easy handling by a user. As another example, the first and second handles may be solid or hollow, depending on their material properties, such as, for example, material strength and weight. Further, the first and second handles, may be tubular. Alternatively, in other embodiments, the first and second handles may not be tubular. As another example, a stop member having a pipe-engaging member capable of fittingly receiving different pipes having different diameters may also be used. Accordingly, this detailed description of embodiments is to be taken in an illustrative, as opposed to a limiting sense.

What is claimed is:

1. A device for bending a pipe comprising:

a first handle including a forming mandrel having an outer edge and a stop member configured to receive and substantially prevent movement of the pipe relative thereto when engaged therewith, and a second handle pivotable relative to the first handle and including a forming head configured to engage and bend the pipe around the forming mandrel when the second handle is pivoted toward the first handle, wherein said stop member includes a pipe-engaging member configured to fittingly receive the pipe therein and a locking member adjacent to said pipe-engaging member, said locking member including a retaining member moveable between (I) a normally projecting position where said retaining member projects toward the pipe-engaging member and directly engages the pipe received in the pipe-engaging member such that the pipe is held between the pipe-engaging member and the retaining member, and (II) a retracted position where the retaining member is retracted away from the pipe-engaging member and is disengaged from the pipe received in the pipe-engaging member, and a biasing member configured to exert a biasing force on the retaining member and bias the retaining member toward the normally projecting position.

2. A device as defined in claim 1, wherein said locking member further includes a bias adjusting member configured to adjust the biasing force the biasing member exerts on the retaining member.

3. A device as defined in claim 2, wherein the biasing member engages the retaining member in compression to exert said biasing force thereon, and the bias adjusting member comprises a screw threadingly engaged with the locking member and rotatable relative thereto to adjust said compression of the biasing member, and, in turn, said biasing force.

4. A device as defined in claim 1, wherein the pipe-engaging member comprises a hook-shaped member configured to engage at least a portion of a circumference of the pipe when engaged with the pipe-engaging member.

5. A device as defined in claim 1, wherein the outer edge of the forming mandrel defines a shape or radius of curvature adapted to substantially provide the pipe with said shape or curvature when bent around the outer edge.

6. A device as defined in claim 1, wherein the outer edge of the forming mandrel defines the pipe channel configured to receive successive portions of a pipe as it is bent around said outer edge.

7. A device as defined in claim 1, wherein the forming head includes at least one channel configured to engage the pipe and press the pipe to and around the outer edge of the forming mandrel when the second handle is pivoted toward the first handle.

8. A device as defined in claim 1, wherein the biasing member comprises a spring.

9. A device for bending a pipe comprising:

a first handle including first means around which the pipe is bendable and second means for receiving and substantially preventing movement of the pipe relative thereto when engaged therewith, and a second handle pivotable relative to the first handle and including third means for engaging and bending the pipe around said first means when the second handle is pivoted toward the first handle, wherein said second means includes fourth means for fittingly receiving the pipe therein and fifth means for securing a pipe therebetween and for substantially preventing movement thereof adjacent to said fourth means, said fifth means including sixth means for retaining the pipe within the fourth means and for moving between (I) a normally projecting position wherein said sixth means directly engages the pipe such that the pipe is held between the fifth means and the fourth means, and (II) a retracted position wherein the pipe is one of (i) movable past the sixth means and into engagement with the fourth means and (ii) movable from engagement with the fourth means, past the sixth means, and out of engagement with the fourth means; and seventh means for exerting a biasing force on the sixth means and for biasing the sixth means toward the normally projecting position.

10. A device as defined in claim 9, wherein said fifth means further comprises eighth means for adjusting said biasing force exerted by the seventh means on the sixth means.

11. A device as defined in claim 10, wherein said first means is a forming mandrel, said second means is a stop member, said third means is a forming head, said fourth means is a pipe-engaging member, said fifth means is a locking member, said sixth means is a retaining member, said seventh means is a biasing member, and said eighth means is a bias adjusting member.

12. A method of bending a pipe comprising:

a mounting step for mounting the pipe within a pipe bending device comprising a first handle including a forming mandrel having an outer edge around which the pipe is bendable and a stop member for receiving and substantially preventing movement of the pipe relative thereto when engaged therewith, and a second handle pivotable relative to the first handle and including a forming head adapted to engage and bend the pipe around the forming mandrel when the second handle is pivoted toward the first handle, wherein said stop member includes a pipe-engaging member adapted to fittingly receive the pipe therein and a locking member adjacent to said pipe-engaging member, said locking member including a retaining member moveable between (I) a normally projecting position where said retaining member projects toward and directly engages the pipe to secure the pipe between the locking member and the pipe-engaging member and, and in turn, substantially preventing movement of the pipe, and (II) a retracted position wherein the pipe is one of (i) movable past the retaining member and into engagement with the pipe-engaging member and (ii) movable from engagement with the pipe-engaging member, past the retaining member, and out of engagement with the pipe-engaging member, and a biasing member configured to exert a biasing force on the retaining member and bias the retaining member toward the normally projecting position; wherein the mounting step comprises an inserting step for inserting the pipe between the forming mandrel and the forming head at a first portion of the pipe to be bent;

a moving step for moving a second portion of the pipe into engagement with the stop member by moving the second portion in between the locking member and the pipe-engaging member to secure the pipe therebetween, thereby substantially preventing movement of the pipe; and a pivoting step for pivoting the second handle toward the first handle to a desired bending angle, thereby bending the pipe around the forming mandrel to said bending angle.

13. A method as defined in claim 12, wherein the outer edge of the forming mandrel defines a pipe channel, and the inserting step comprises placing the first portion of the pipe within the pipe channel.

14. A method as defined in claim 12, wherein the moving step further comprises applying a force greater than the biasing force exerted by the biasing member onto the retaining member and thereby moving the retaining member from the projecting position to the retracted position, and, in turn, sliding the second portion of the pipe past the retaining member toward the pipe-engaging member thereby allowing the retaining member to return to the projecting position and secure the pipe therebetween.

15. A method as defined in claim 12, wherein the locking member further includes a bias adjusting member configured to adjust the biasing force the biasing members exerts on the retaining member, and further comprising an adjusting step for adjusting the bias adjusting member to thereby adjust the biasing force.

16. A method as defined in claim 15, wherein the bias adjusting member comprises a screw threadingly engaging the locking member, and the adjusting step comprises rotating the screw relative to the locking member, thereby adjusting compression of the biasing member, and, in turn adjusting the biasing force.

17. A method as defined in claim 12, wherein the pivoting step further comprises holding solely the first handle with one hand, and holding solely the second handle with another hand, and pivoting the second handle toward the first handle.

18. A method as defined in claim 12, further comprising the steps of:

pivoting the second handle away from the first handle, moving the pipe out of engagement with the stop member by moving the pipe from between the locking member and the pipe-engaging member by applying a force greater than the biasing force exerted by the biasing member onto the retaining member and thereby moving the retaining member from the projected position to the retracted position and, in turn, removing the pipe from the pipe-engaging member, and removing the pipe from between the forming mandrel and the forming head.

* * * * *